US008408097B2

(12) United States Patent
Grohmann et al.

(10) Patent No.: US 8,408,097 B2
(45) Date of Patent: Apr. 2, 2013

(54) SCREWING TOOL

(75) Inventors: Klaus Grohmann, Hersdorf (DE); Lothar Thommes, Bitburg (DE)

(73) Assignee: Grohmann Engineering GmbH, Pruem (DE)

( * ) Notice: Subject to any disclaimer, the term of this patent is extended or adjusted under 35 U.S.C. 154(b) by 368 days.

(21) Appl. No.: 12/678,679

(22) PCT Filed: Sep. 25, 2008

(86) PCT No.: PCT/EP2008/008116

§ 371 (c)(1),
(2), (4) Date: Mar. 17, 2010

(87) PCT Pub. No.: WO2009/043531

PCT Pub. Date: Apr. 9, 2009

(65) Prior Publication Data

US 2010/0199811 A1 Aug. 12, 2010

(30) Foreign Application Priority Data

Oct. 4, 2007 (DE) ..... 10 2007 047 611

(51) Int. Cl.
*B25B 21/00* (2006.01)

(52) U.S. Cl. ..... 81/54; 81/429; 81/57.36

(58) Field of Classification Search ..... 81/54, 55, 81/429, 124.5, 180.1, 57.36, 52; 173/213, 173/214

See application file for complete search history.

(56) References Cited

U.S. PATENT DOCUMENTS 1,677,473 A * 7/1928 Gast ..... 81/55
3,779,105 A * 12/1973 Triplett et al. ..... 81/124.5
5,207,127 A * 5/1993 Nick ..... 81/54
5,255,485 A * 10/1993 Lemke et al. ..... 81/52

FOREIGN PATENT DOCUMENTS

DE 195 27 115 1/1997

* cited by examiner

*Primary Examiner* — Hadi Shakeri
(74) *Attorney, Agent, or Firm* — Lucas & Mercanti, LLP

(57) ABSTRACT

The invention relates to a screwing tool that comprises a drive arranged in a housing and an output shaft connected to said drive, a screwdriver point being arranged at the front face of the output shaft. The aim of the invention is to provide a screwing tool with which different connecting elements, in particular actuating and clamping elements consisting of a screwable sleeve and an inner screw can be screwed with only a single screwing tool. In order to achieve this aim, the screwing tool comprises a receiving part (500) which surrounds the output shaft and is displaceably guided in the direction of the axis (202) of the output shaft (200) against the force of a return element (505). Furthermore, an annular screwing tool (400), which surrounds the output shaft (200) and the screwdriver point (201), is rotatably mounted on the receiving part (500) for detecting the drive contours (305) of the peripheral surface (304) of a connecting element (303), at least one shiftable clutch (600) being arranged between the rotatably mounted annular screwing tool (400) and the output shaft (200).

6 Claims, 1 Drawing Sheet

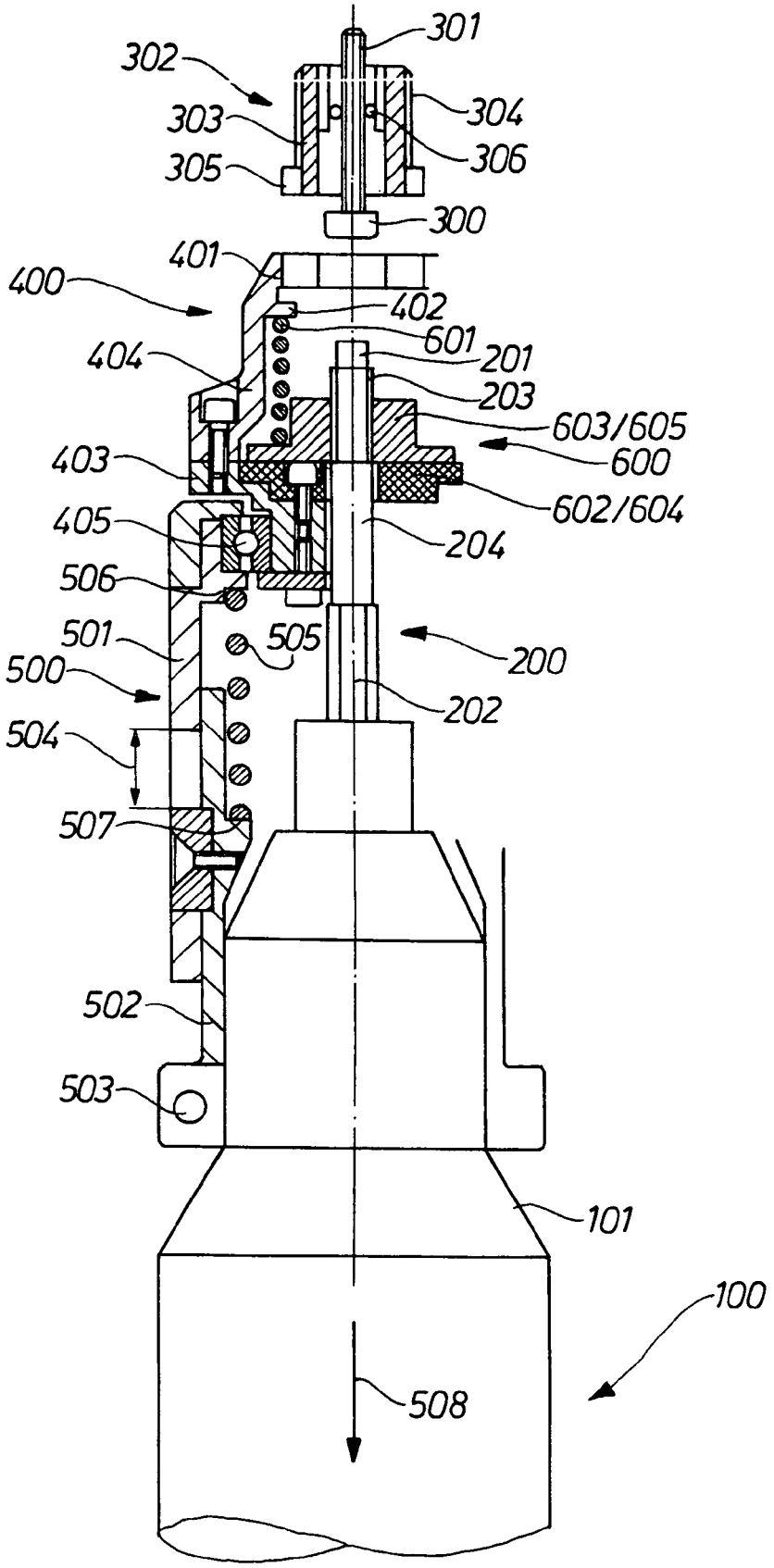
301
302
303
304
305
306
300
401
400
402
601
404
201
203
603/605
403
600
602/604
405
204
506
501
505
200
500
202
504
507
502
503
101
100
508

SCREWING TOOL

CROSS REFERENCED TO RELATED APPLICATION

This is a U.S. national stage of application No. PCT/EP2008/008116, filed on Sep. 25, 2008. Priority is claimed on German Application No. 10 2007 047 611.8, filed Oct. 4, 2007, the content of which is incorporated here by reference.

BACKGROUND OF THE INVENTION

1. Field of the Invention

The invention pertains to a screwing tool with a drive installed in a housing and with an output shaft connected to the drive, a screwdriver being mounted on the end of the shaft.

2. Description of Prior Art

In electrically or pneumatically driven screwing tools, the conventional practice is to use short, replaceable screwdriver tips (also called "bits"). The screwdriver tips are designed to fit different shapes of screw heads, especially slotted screws, Phillips screws, Allen screws, and Torx screws. These types of screw-driving tools are available in different forms, including the widely used Akku screwdriver, by means of which components can be fastened to each other quickly with minimal expenditure of force and without damaging the head of the screw.

Because of the advantages described above, the use of motorized screwing tools has been widely adopted especially in the field of automobile manufacturing. For certain assembly tasks on motor vehicles, so-called "positioning-and-clamping" elements must be fastened to the vehicle; these elements consist of a hollow cylindrical bushing and an internal screw, which extends through hollow cylinder. These positioning-and-clamping elements are currently being attached by means of two different screwing tools. The threaded bushing is screwed in with a ring-shaped screwing tool, which grips the drive profiles on the lateral surface of the bushing. The internal screw is screwed in with a screwdriver with a rotating bit, which engages in the end surface of the head of the screw.

In many cases, it is necessary to take into account the fact that the torque which must be applied to tighten the internal screw may be different from that to be applied to the bushing, which means that the screwing tools which must be kept on hand must comprise shut-off clutches with different shut-off torques.

SUMMARY OF THE INVENTION

Proceeding from this prior art, an object of the invention is to provide a screwing tool of the type described above by means of which different fastening elements, especially positioning-and-clamping elements consisting of a sleeve, which can be screwed into place, and an internal screw can be installed with only a single screwing tool. Another goal of the invention consists in being able to tighten different fastening elements by the application of different torques.

This goal is achieved in the case of a screwing tool of the type described above in that the screwing tool comprises a mounting part, which surrounds the output shaft and which is guided so that it can move along the axis of the output shaft against the force of a restoring element; in that a ring-shaped screwing tool, which is designed to grip the drive contours on the lateral surface of a fastening element, surrounds the output shaft and the screwdriving bit, and is rotatably supported on the mounting part; and in that at least one shiftable clutch is arranged between the rotatably supported, ring-shaped screwing tool and the output shaft.

The axial mobility of the mounting part makes possible relative movement between the ring-shaped screwing tool rotatably supported on the mounting part and the screwdriving bit, which is mounted on the end of the output shaft, so that either the ring-shaped screwing tool or the screwdriving bit can be used. So that the screwdriving bit can be used, a force must be exerted in the axial direction of the output shaft against the head of the screw. As a result, the mounting part moves along the axis of the output shaft against the force of the restoring element and away from the screw-driving bit, so that the bit can grip the head of the internal screw.

Between the rotatably supported ring-shaped screwing tool and the output shaft, at least one shiftable clutch is arranged, which allows or prevents force from flowing between the output shaft and the ring-shaped screwing tool. The shiftable clutch is preferably designed to be nonpositive and self-shifting and especially to be in the form of a friction clutch, which, when the tightening torque is reached, interrupts the flow of force between the output shaft and the ring-shaped screwing tool. The structural design of the friction clutch makes it possible to determine the tightening torque of the ring-shaped screwing tool. The friction clutch is preferably designed as a multi-plate clutch. In principle, however, other designs can also be considered.

In an especially preferred embodiment of the invention, an externally shifted, positive clutch is also installed between the rotatably supported ring-shaped screwing tool and the output shaft in addition to the nonpositive, self-shifting friction clutch. This positive clutch is preferably shifted so that the axial displacement of the first clutch element along the axis of the output shaft interrupts the flow of force between the first clutch element of the friction clutch connected to the output shaft and the output shaft. This axial displacement of the first clutch element is supported in that the first clutch element is acted upon by the force of a spring, which is arranged between the first clutch element and the ring-shaped screwing tool. The spring force which determines the torque of the friction clutch is directed toward the second clutch element. Because of this design, the axial displacement of the mounting part required in any case for the use of the screwdriver bit simultaneously brings about an axial displacement of the first clutch element of the friction clutch along the axis of the output shaft into an area of the output shaft where the positively engaging contours of the additional clutch are disengaged. The additional clutch prevents torque from being applied to the ring-shaped screwing tool by the disconnected output shaft during the use of the screwdriver bit. This freedom from torque is not absolutely necessary, however, because the friction clutch is designed in such a way that it effectively prevents the tightening torque of the fastening element gripped by the ring-shaped screwing tool from being exceeded.

The preferably sleeve-like mounting part for the rotatable support of the ring-shaped screwing tool is preferably guided so that it can move in the axial direction of the output shaft but cannot turn with respect to the housing of the screwing tool. A key, for example, can be used to prevent this mounting part from turning.

To prevent the ring-shaped screwing tool from turning when the internal screw is being screwed in by the screwdriving bit, means for temporarily locking the ring-shaped screwing tool in place are preferably arranged on the mounting part. Positively engaging contours or frictional means, such as in the form of a friction coating or a set of teeth can be considered as ways to achieve this locking function. The locking means preferably engage automatically as a result of the axial movement of the mounting part, i.e., when the mounting part is shifted toward the housing of the screwing tool.

BRIEF DESCRIPTION OF THE DRAWINGS

The invention is explained in greater detail below on the basis of the figures.

FIG. 1 is a schematic cross sectional view of a screwing tool according to an embodiment of the invention.

DETAILED DESCRIPTION OF THE PREFERRED EMBODIMENTS

The inventive screwing tool comprises a conventional screwdriver (100) with an electric drive installed in a housing (101), only part of which is shown in FIG. 1. The drive is connected to an output shaft (200). Between the electric drive (not shown) of the screwdriver (100) and the output shaft (200), a mechanical or electronic torque shut-off clutch is usually installed, which interrupts the flow of force between the electric drive and the output shaft (200) when the desired tightening torque is reached. The screwdriver bit (201), which, in the exemplary embodiment shown here, is designed as a Torx bit in the form of a six-pointed star, is mounted at the front end of the output shaft (200).

The front end of the screwdriver bit (201) can be inserted into the head (300) of an internal screw (301). The internal screw (301) is a component of a so-called "positioning-and-clamping" element (302), which is used for assembly purposes in the automobile industry. As can be seen in FIG. 1, the internal screw (301) is surrounded by a hollow cylindrical bushing (303). The bushing (303) comprises drive contours (305) on its lateral surface (304), which can be set into rotation by a ring-shaped screwing tool (400). An elastic ring (306) surrounding the internal screw (301) is arranged between the bushing (303) and the internal screw (301) of the positioning-and-clamping element (302).

So that the screwdriver (100) can tighten both the internal screw (301) of the positioning-and-clamping element (302) and the bushing (303), the screwdriver (100) also comprises the ring-shaped screwing tool (400), which is supported rotatably on a mounting part (500), which is guided so that it cannot turn but can shift position along the axis (202) of the output shaft (200).

Between the rotatably supported, ring-shaped screwing tool (400) and the output shaft (200), there is a clutch arrangement (600) for the transmission of torque.

At the front end, the ring-shaped screwing tool (400) comprises a ring-shaped profile (401), which cooperates with the drive contours (305) of the bushing (303). In the direction of the axis (202) and underneath the ring-shaped profile (401), there is a shoulder (402), which serves as an end stop for the bushing (303) and also as an abutment for a spring (601), which acts on the clutch arrangement (600). In the exemplary embodiment shown here, the spring (601) is designed as a helical spring. At the end opposite the profile (401), the ring-shaped screwing tool (400) comprises a bearing shell (403), which, in the exemplary embodiment shown here, is detachably connected to a threaded sleeve (404). The bearing shell (403) and the threaded sleeve (404), however, can also be designed as a one-piece unit.

A driver disk (602) of the clutch arrangement (600) is also connected nonrotatably to the ring-shaped screwing tool (400). The way in which this clutch element (604) works and operates is explained in greater detail below.

The mounting part (500) is formed by a sliding sleeve (501), which concentrically surrounds a hollow cylindrical clamping ring (502). At the end surface facing the housing (101) of the screwdriver (100), the clamping ring (502) is connected to a clamping device (503), which makes it possible to clamp the clamping ring nonrotatably to the housing (101). This simple clamped connection makes it easy to retrofit conventional screwdrivers (100) with the components essential to the invention (400, 500, 600).

The sliding sleeve (501) is guided in such a way that it can shift position axially relative to the clamping ring (502) along the axis (202) from the starting position shown in FIG. 1 by the displacement distance (504). The displacement out of the starting position takes place against the force of a spring (505), which acts as restoring element and which is designed as a spiral spring. The top end of the spring (505) rests against an edge (506) at the end of the sliding sleeve (501), whereas the bottom end of the spring (505) rests on a circumferential shoulder (507) of the clamping ring (502).

The clutch arrangement (600) between the rotatably supported ring-shaped screwing tool (400) and the output shaft (200) consists, first, of a friction clutch with a first clutch element (603) and a second clutch element (604), and, second, of an externally shifted, positively-engaging additional clutch.

The first clutch element (603) of the friction clutch is designed as a driver disk (605). In the starting position of the screwing tool shown in FIG. 1, a set of internal teeth on the first clutch element (603) in the form of a driver disk (605) engages positively in the circumferential direction of the output shaft with an externally toothed section (203) of the output shaft (200). The frictional force required between the first and second driver disk (602, 605) is determined essentially by the spring (601).

When the sliding sleeve (501) is shifted out of the starting position shown in FIG. 1 by the displacement distance (504) in the direction of the arrow (508), the screwing tool (400), supported rotatably on the mounting sleeve (501) by means of the ball bearing (405), moves, together with the two driver disks (602, 605) of the friction clutch, relative to the output shaft (200), wherein the internally toothed pass-through opening in the driver disk (605) arrives in a section (204) of the output shaft (200) which is narrowed down with respect to, i.e., has a smaller diameter than, the externally toothed section (203), so that the flow of force between the output shaft (200) and the first clutch element (603) in the form of the driver disk (605) is interrupted. The pass-through opening in the driver disk (602) is always located in the narrowed-down section (204), so that at no time is any torque exerted directly on its pass-through opening by the output shaft (200).

This positively-engaging clutch (203/204) is shifted by the application of a thrusting force on the screwdriver (100) in the direction opposite the force of the spring (505), which must be exerted in any case when the screwdriver bit (201) is intended to engage in the head (300) of the internal screw (301). The disconnection of the ring-shaped screwing tool (400) from the output shaft (200) which then occurs automatically has the result that no torque is applied any longer to the bushing (303), whereas the internal screw (301) is turned. The tightening torque for the internal screw (301) is determined exclusively by the torque predetermined by the shut-off clutch of the screwdriver (100); this torque can be different from the torque for the bushing (303) specified by the friction clutch.

The end result is that the inventive screwing tool makes it possible for different types of fastening elements, especially the bushing (303) and the internal screw (301), to be screwed in with different tightening torques by means of a single screwing tool. The need for setting a screwing tool in position twice and for keeping different screwing tools on hand is eliminated, as a result of which, especially in industrial manufacturing processes such as those in the automobile industry, considerable cost savings through reduced assembly times and tooling costs can be achieved.

List of Reference Numbers

| No. | Name |
|---|---|
| 100 | screwdriver |
| 101 | housing |
| 200 | output shaft |
| 201 | screwdriving bit |
| 202 | axis |
| 203 | externally toothed section |
| 204 | narrowed-down section |
| 300 | head |
| 301 | internal screw |
| 302 | positioning-and-clamping element |
| 303 | bushing |
| 304 | lateral surface |
| 305 | drive contour |
| 306 | elastic ring |
| 400 | ring-shaped screwing tool |
| 401 | ring-shaped profile |
| 402 | shoulder |
| 403 | bearing shell |
| 404 | threaded sleeve |
| 405 | ball bearing |
| 500 | mounting part |
| 501 | sliding sleeve |
| 502 | clamping ring |
| 503 | clamping device |
| 504 | displacement |
| 505 | spring (restoring element) |
| 506 | edge at end surface |
| 507 | circumferential shoulder |
| 508 | directional arrow |
| 600 | clutch arrangement |
| 601 | spring |
| 602 | driver disk |
| 603 | first clutch element |
| 604 | second clutch element |
| 605 | driver disk |

The invention claimed is:

1. A screwing tool, comprising:

a housing:

a drive arranged in the housing;

an output shaft connected to the drive and having an axis of rotation, a screwdriver bit being mounted on one end of the output shaft;

a mounting part surrounding the output shaft and guided such that the mounting part is axially movable along the axis of the output shaft;

a restoring element, wherein the mounting part is axially movable against a force of the restoring element;

a ring-shaped screwing tool surrounding the output shaft and the screwdriver bit, the ring-shaped screwing tool being rotatably mounted on the mounting part and configured to grip drive contours on a lateral surface of a connecting element to be screwed-in by the ring-shaped screwing tool;

at least one shiftable clutch arranged between the ring-shaped screwing tool and the output shaft, wherein the at least one shiftable clutch is a nonpositive and self-shifting friction clutch with first and second clutch elements; and an additional externally shifted positive clutch arranged between the ring-shaped screwing tool and the output shaft.

2. The screwing tool of claim 1, wherein the first clutch element is connected to the output shaft, a flow of force between the first clutch element and the output shaft is interruptible by an axial displacement of the first clutch element along the axis of the output shaft.

3. The screwing tool of claim 2, wherein the first clutch element and output shaft comprise positively engaging contours that act in a circumferential direction of the output shaft and that can he brought into and out of engagement by the axial displacement of the first clutch element.

4. The screwing tool of claim 1, further comprising a spring arranged between the first clutch element and the ring-shaped screwing tool, wherein a force of the spring acts on the first clutch and is directed toward the second clutch element.

5. The screwing tool of claim 1, wherein the mounting part is guided so that it is fixed with respect to rotation relative to the housing.

6. The screwing tool of claim 1, the mounting part further comprising means for temporarily arresting the ring-shaped screwing tool in place.

* * * * *